United States Patent [19]

Joseph

[11] 4,023,698

[45] May 17, 1977

[54] HANDLING CONTAINER, NOTABLY PALLET TOTE OR HEIGHTENING BOX

[75] Inventor: Raymond Joseph, Schiltigheim, France

[73] Assignee: Ateliers Reunis Societe Anonyme, Schiltheim, France

[22] Filed: July 1, 1976

[21] Appl. No.: 701,867

[30] Foreign Application Priority Data

July 10, 1975 France ..... 75.21666

[52] U.S. Cl. ..... 220/7; 220/19; 292/300; 220/331; 217/47; 217/15

[51] Int. Cl.² ..... B65D 7/24; B65D 7/20; B65D 51/04

[58] Field of Search ..... 220/19, 1.5, 7, 331; 292/300, 301, 302, 304; 217/43 R, 43 A, 47, 12 R, 15

[56] References Cited

UNITED STATES PATENTS

| | | | |
|---|---|---|---|
| 3,288,484 | 11/1966 | Brunette | 292/300 X |
| 3,348,723 | 10/1967 | Wilson | 220/19 X |
| 3,372,829 | 3/1968 | Averill | 220/19 X |
| 3,812,999 | 5/1974 | Joseph | 220/19 X |

*Primary Examiner*—William Price
*Assistant Examiner*—Steven M. Pollard
*Attorney, Agent, or Firm*—Michael J. Striker

[57] ABSTRACT

This container, such as a tote box or pallet heightening container, comprises an opening in one of its side walls, and at least one movable shutter for closing said opening. The shutter is hingedly mounted at its bottom edge by means of elongated rings to the bottom edge of the opening or of the next underlying shutter, if any. Side lock bolts are rigidly secured to the upper portion of each shutter and adapted to engage through notches a U-sectioned lateral slideway running along the lateral edges of the opening. Detent means are provided for holding the shutter in its open position.

7 Claims, 9 Drawing Figures

HANDLING CONTAINER, NOTABLY PALLET TOTE OR HEIGHTENING BOX

BACKGROUND OF THE INVENTION

1. Field of the Invention

The present invention relates to handling or stock containers such as pallet transport or heightening boxes, also referred to as tote boxes.

2. Description of the Prior Art

Most containers or receptacles of this character comprise on one or several lateral walls an opening closed by one or more hinged shutters in order to facilitate the access to the packaged, bagged or like material or goods contained therein when the top portion of the material has already been removed. As a rule, these shutters are kept in their closed position by lock bolts or retaining hooks. However, both locking systems are attended by various inconveniences.

In fact, lock-bolt systems are relatively expensive and their operation requires the use of both hands. Besides, when closing the shutter it is necessary to position the shutter very accurately in the proper position to permit the engagement of the lock bolts into the corresponding retaining keepers.

Hook-type closing devices are advantageous in that they are very simple, since they consist only of a pair of hooks mounted along the edges of the opening and adapted to be engaged by fastening straps or loops carried by the matching sides of the corresponding shutter. In this case, the lower edge of the shutter is hingedly mounted by means of elongated rings affording a certain degree of liberty of movement in the vertical direction to facilitate the engagement of said straps or loops on the retaining hooks. The thus hooked shutter is subsequently kept in position by gravity.

However, the efficiency of this system is also objectionable for in case of shocks, jolts or vibration the straps or loops keeping the shutter in its closed position are likely to free themselves untimely from the corresponding retaining hooks. On the other hand, the shutters are not perfectly held against movement since considerably play is present at various points and for the same reason it is a frequent occurrence that operators do not properly fasten the shutters by using only one of the closing hooks.

SUMMARY OF THE INVENTION

It is the primary object of the present invention to avoid the various above-listed inconveniences by providing simple yet efficient means for safely holding the closing shutters against movement. It is another object of this invention to provide a structure so designed that the shutter opening and closing operations can be performed very easily with only one hand by the operator.

For this purpose, the present invention provides a container of the above-mentioned type, wherein the shutter or each shutter to be used for closing a wall opening is provided with at least one lock bolt on its sides, both side edges of the corresponding opening comprising a vertical U-sectioned retaining slideway adapted to be engaged by the relevant lock bolts, the outer wing of each slideway comprising notches permitting the passage of said lock bolts. Now, these notches are located at a level somewhat higher than that corresponding to the normal position of said lock bolt when the corresponding shutter is in its normal closed position, the shutter or shutters being hingedly mounted by means of elongated rings whereby each shutter can be somewhat raised in relation to the element on which it is hingedly mounted.

With this arrangement it is thus very easy to introduce the shutter lock bolts into the retaining slideways provided on each side. The shutters are thus safely held against movement in all directions and cannot open untimely as a consequence of shocks, vibration or jolts. Besides, it is not possible to position the shutters askew or to fit them in a wrong position.

However, other specific properties and advantages of the containers according to this invention will appear as the following description proceeds with reference to the accompanying drawing, in which:

DESCRIPTION OF THE PREFERRED EMBODIMENT

Figure 1:
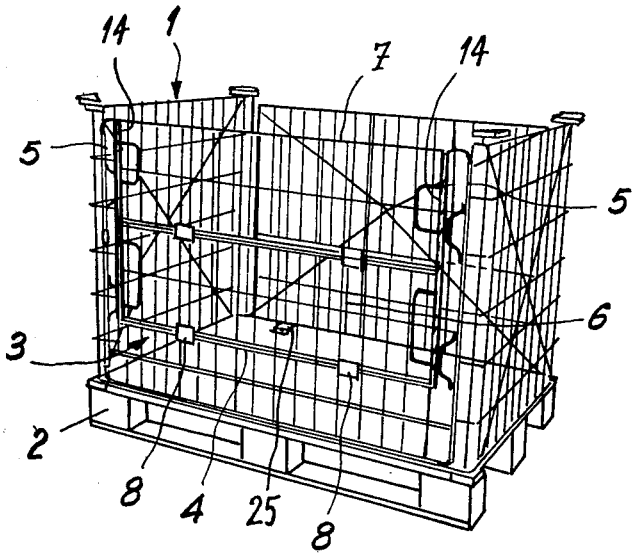
FIG. 1 is a perspective view illustrating a pallet heightening container constructed according to the teachings of the present invention.
Figure 5:
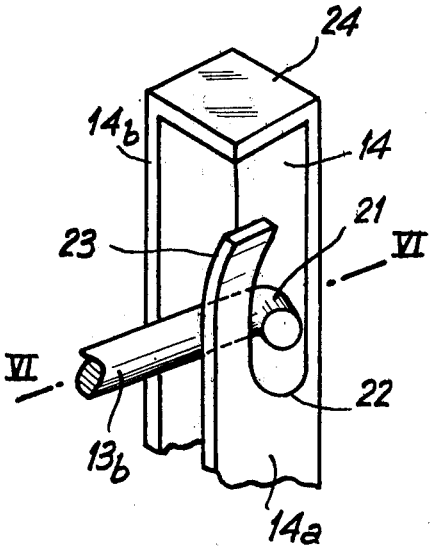
FIG. 5 is a fragmentary perspective view showing a detail of the specific means for retaining the lock bolts carried by the upper portion of each movable shutter.
Figure 6:
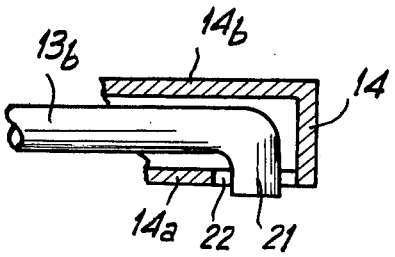
FIG. 6 is a fragmentary section taken along the line VI—VI of FIG. 5.
Figure 2:
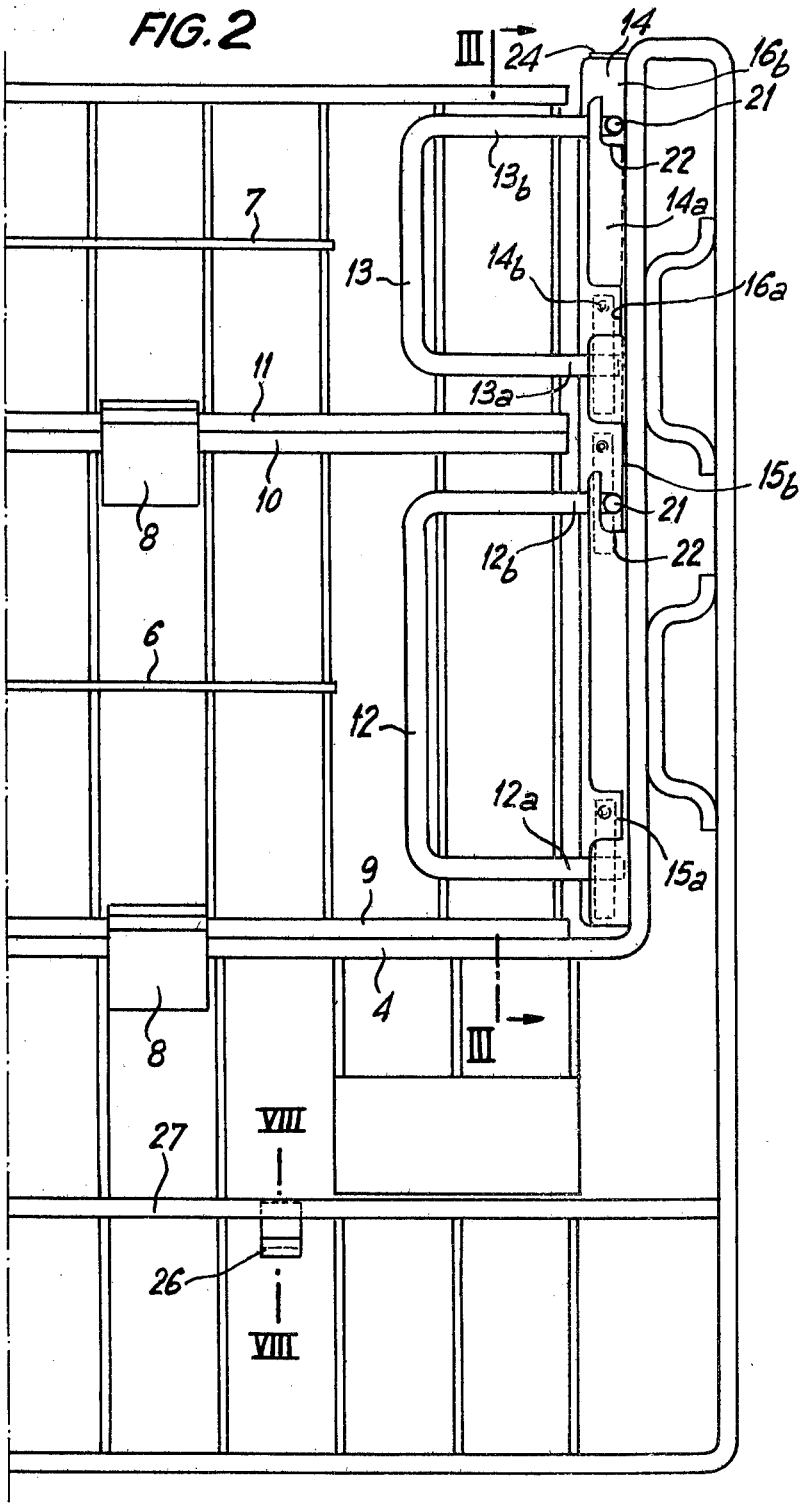
FIG. 2 is a fragmentary front elevational view of one of the walls of the heightening container of FIG. 1, which comprises an opening closed by a pair of movable shutters.
Figure 3:
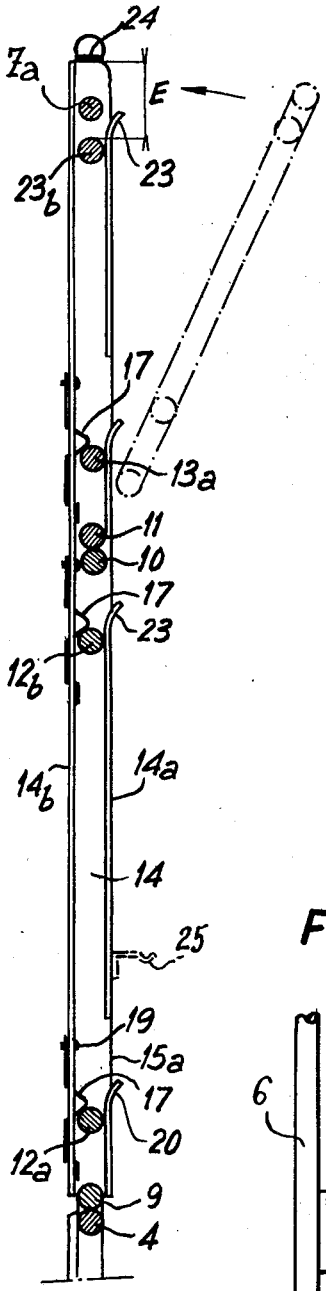
FIG. 3 is a fragmentary section taken along the line III—III of FIG. 2.
Figure 4:
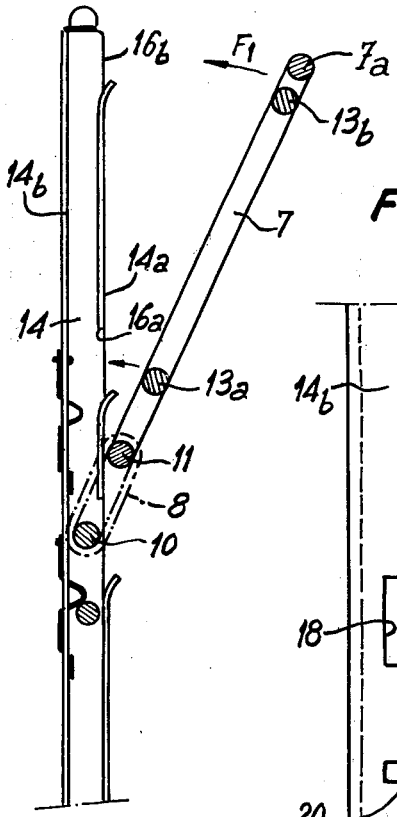
FIG. 4 is a fragmentary section taken along the same plane as FIG. 2 but illustrating the upper closing shutter in a position prior to its closed and locked condition.
Figure 7:
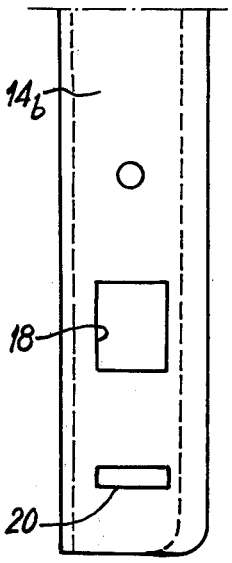
FIG. 7 is a fragmentary elevational view of one of the retaining slideways.
Figure 9:
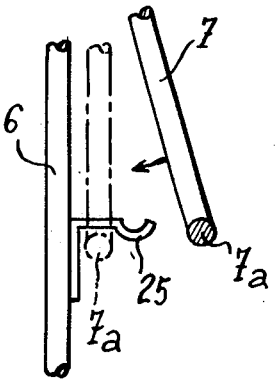
FIG. 9 is a fragmentary elevational view of a detail.

The pallet heightening container 1 illustrated in FIG. 1 has a generally parallelipipedic, bottomless configuration and comprises therefore four vertical walls constituting the four sides adapted to be fitted on the top of a transport pallet 2 for retaining the packaged, bagged or otherwise enclosed material or goods carried by the transport pallet 2.

The four walls of this pallet heightening container 1 consist of gratings made of crossed metal wire as well known in the art. The four sides are assembled along their edges or interconnected by hinge means so that the assembly can be folded when necessary.

One of the side walls, for instance the front wall 3, of the container comprises a relatively wide opening extending from its top edge down to a transverse longitudinal member 4 somewhat spaced above the bottom or lower edge of the container; this opening is bounded laterally by two uprights 5 also made of metal wire, but if desired they may consist of extensions of said longitudinal member 4. Now in the present example this opening is adapted to be closed by a pair of superposed movable shutters 6 and 7 hingedly mounted to permit the opening thereof by tilting outwardly and thus free the opening and facilitate the access to the inner space of the pallet heightening container 1.

The lower shutter 6 is hingedly mounted on the longitudinal member 4 by means of a pair of elongated rings top abutment plates 24 will thus permit of firstly opening the upper shutter 7. Of course, when this upper shutter 7 has been folded outwardly, the lower shutter 6 can then be opened in turn.

Figure 8:
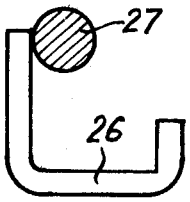
FIG. 8 is a section taken along the line VIII—VIII of FIG. 2 but on a smaller scale.

Preferably, the upper shutter 7 has a smaller height than the lower shutter 6 and the latter carries on its outer surface a resilient clip 25 or a detent spring adapted to hold in position the upper shutter 7 when folded against the lower shutter 6. On the other hand, the lower portion of the front wall 3 comprises in turn retaining hooks 26 or like members adapted to hold the lower shutter 6 against movement when this shutter has also been folded outwardly. These hooks 26 are secured to one of the longitudinal members 27 constituting the lower portion of the wall 3 (see FIG. 8). Thus, the two movable shutters 6 and 7 are safely and reliably held in their position.

Howevser, the primary advantageous feature characterising the containers according to the present invention lines in the specific manner in which the shutters are held in their closed position. In fact, due to the engagement of the lock bolts into the lateral retaining slideways 14 both shutters are properly retained in this position and cannot under any circumstances be released by shocks or jolts. Besides, the springs 17 prevent the lock bolts from being lifted inadvertendly.

However, it may be noted that due to their particular configuration these springs 17 retract automatically when the lock bolts are caused forcibly to slide in the slideways 14 towards their final retaining positions. Due to the pressure exerted by the corresponding lock bolts, driven by the weight of the movable shutters 6 and 7, these springs 17 are pushed outwards to free the passage, whereafter they resume their initial shape and position and hold the lock bolts in the vertical direction.

Now it may be seen that the same lock bolts are also held against movement in all the other directions by the retaining slideways 14 proper. On the other hand, the clearances provided are relatively moderate, thus precluding any possibility of untimely movement of said movable shutters.

Another advantageous feature characterising this invention is that neither one nor the other of the movable shutters can be improperly anchored at only one side, as observed with conventional and known locking system equipping containers of this type.

Of course, the container structure described hereinabove and illustrated in the accompanying drawing should not be construed as limiting the scope of the present invention. In fact, it may comprise if desired only one movable shutter, or, conversely, it may comprise three or more shutters disposed in superposed yet coplanar relationship, each shutter carrying a pair of lock bolts on each lateral side.

Possibly, a single lock bolt may be provided on each side of the movable shutters, but this solution though more economical would not be so advantageous in actual practice since the shutters would not be perfectly held against movement in their closed position.

Finally, instead of constituting a simple heightening container or box for pallets, the container according to this invention may constitute a tote box by itself, or any other large-sized receptacle likely to be utilized for storage purpose or for handling and transporting miscellaneous goods, notably packaged or bagged goods.

What is claimed as new is:

1. A container for handling and storage purposes, such as a tote box or a pallet heightener, having a substantially paralellipipedic configuration and at least one opening in at least one side wall which is closed by one or a plurality of hingedly mounted shutters adapted to be tilted downwards to their open position, wherein each shutter comprises at least one lock bolt rigidly secured to each side edge, the registering edges of said opening comprising each a fixed vertical retaining slideway consisting of a U-sectioned member having its aperture coplanar with, and facing, said shutter, said slideway being adapted to be engaged by said lock bolt, the outer wing of said U-shaped section comprising a notch permitting the passage of said lock bolt therethrough, said notches being disposed at a level somewhat higher than that occupied by said lock bolts in the normal closed position of said shutter, said shutters being hingedly mounted on the container by means of elongated rings permitting the upward movement of said shutters as necessary for inserting said lock bolts into said notches.

2. A container as recited in claim 1, which comprises at least two movable shutters disposed in superposed relationship for closing one opening, each lateral retaining slideway formed on either side of said shutters being closed at its top by an abutment member adapted to stop the lock bolt of the upper shutter in a position such that the underlying shutter, due to the provision of said elongated rings interconnecting the shutters, cannot be carried along during the lifting of said upper shutter preliminary to the opening or closing movement thereof.

3. A container as recited in claim 2, wherein each lateral retaining slideway comprises one or a plurality of retractable detent springs or spring-urged detent pawls adapted to retain one or a plurality of lock bolts of the relevant movable shutter or shutters, in order to prevent the untimely upward movement thereof, said springs or pawls being adapted to retract from the inner space of said slideways under the pressure exerted by said lock bolts when said shutters are forcibly moved up- or downwards.

4. A container as recited in claim 3, wherein at least one of said lock bolts of the shutter or shutters has a bent end portion and the relevant wing of said retaining slideways has a vertical notch formed therein for receiving the bent portion of the relevant lock bolt, said vertical notch communicating with the inlet notch located just above it.

5. A container as recited in claim 4, wherein at least two superposed movable shutters are provided for closing a single opening formed in a side wall of the container, wherein the height of the upper shutter is smaller than that of the lower shutter, said underlying shutter carrying at its upper edge a resilient means adapted resiliently to engage and retain the upper shutter when the latter is tilted downwards against the outer surface of said lower shutter, in order to render said shutters solid with each other.

6. A container as recited in claim 5, wherein said resilient means consists of a clip.

7. A container as recited in claim 5, wherein said resilient means consists of a shaped spring.

* * * * *